US005740927A

United States Patent [19]

Yemini

[11] Patent Number: 5,740,927

[45] Date of Patent: Apr. 21, 1998

[54] TOOL RACK

[75] Inventor: Zvi Yemini, Tel Aviv, Israel

[73] Assignee: Zag Ltd., Rosh Haayin, Israel

[21] Appl. No.: 781,016

[22] Filed: Jan. 9, 1997

[51] Int. Cl.[6] ..... A47F 7/00

[52] U.S. Cl. ..... 211/70.6; 211/66; 211/94.01

[58] Field of Search ..... 211/94.01, 94.02, 211/70.6, 65, 66

[56] References Cited

U.S. PATENT DOCUMENTS

| | | | |
|---|---|---|---|
| 2,754,974 | 7/1956 | Larson | 211/70.6 |
| 4,693,381 | 9/1987 | Lodge | 211/94.01 |
| 4,771,897 | 9/1988 | Ho | 211/94.01 |
| 4,869,378 | 9/1989 | Miller | 211/94.01 |
| 5,224,609 | 7/1993 | Bauer et al. | 211/70.6 |
| 5,472,167 | 12/1995 | Shillington et al. | 211/94.01 |
| 5,524,772 | 6/1996 | Simmons | 211/4 |

FOREIGN PATENT DOCUMENTS

| | | | |
|---|---|---|---|
| 2277249 | 10/1994 | United Kingdom | 211/70.6 |

*Primary Examiner*—Milton Nelson, Jr.
*Assistant Examiner*—Anthony D. Barfield
*Attorney, Agent, or Firm*—Mark M. Friedman

[57] ABSTRACT

A tool rack for hanging tools such as garden tools on a wall comprising (a) at least one hanging implement for hanging a tool, each of the hanging implements including (i) hanging device for engaging the tool; (ii) first securing device having a first profile, the first securing device being connected to or integrally formed with the hanging device; and (iii) a locking device, the locking device including an integral hinge connected to or integrally formed with the hanging device and a first member of a locking implement connected to or integrally formed with the hinge, the first member of the locking implement having a second profile; and (b) an elongated body including a first end, the elongated body being formed with (i) a first extended securing groove, the first extended securing groove extending along the elongated body starting at the first end, the first extended securing groove having a third profile, the third profile being shaped and dimensioned to slideably accommodate the first profile of the first securing device of the hanging implement, such that the first securing device is inserted into the first extended securing groove via the first end; and with (ii) a second member of the locking implement, the second member of the locking implement having a fourth profile shaped and dimensioned to tightly accommodate the second profile of the first member of the locking implement, such that by bending the first member of the locking, implement via the integral hinge the first and second members of the locking implement become locked to one another and, as a result, each of the hanging implements becomes locked to a specific position along the elongated body.

12 Claims, 3 Drawing Sheets

TOOL RACK

FIELD AND BACKGROUND OF THE INVENTION

The present invention relates to a tool rack. More particularly, the present invention relates to a tool rack for tools such as garden tools.

Tools, such as garden tools (e.g., shovel, rake, hoe, etc.), and other tools (e.g., broom) are typically equipped with a long handle to which an effective, typically wide, head is attached. Such tools are best kept organized when stored hanged on a wall.

The present invention provides an improved tool rack for hanging tools on a wall.

SUMMARY OF THE INVENTION

According to the present invention there is provided a tool rack which can be used to hang tools such as garden tools on a wall.

According to further features in preferred embodiments of the invention described below, the tool rack, comprising (a) at least one hanging implement for hanging a tool, each of the hanging implements including (i) a hanging device for engaging the tool; (ii) a first securing device having a first profile, the first securing device being connected to or integrally formed with the hanging device; and (iii) a locking device, the locking device including an integral hinge connected to or integrally formed with the hanging device and a first member of a locking implement connected to or integrally formed with the hinge, the first member of the locking implement having a second profile; and (b) an elongated body including a first end, the elongated body being formed with (i) a first extended securing groove, the first extended securing groove extending along the elongated body starting at the first end, the first extended securing groove having a third profile, the third profile being shaped and dimensioned to slideably accommodate the first profile of the first securing device of the hanging implement, such that the first securing device is inserted into the first extended securing groove via the first end; and with (ii) a second member of the locking implement, the second member of the locking implement having a fourth profile shaped and dimensioned to tightly accommodate the second profile of the first member of the locking implement, such that by bending the first member of the locking implement via the integral hinge, the first and second members of the locking implement become locked to one another and, as a result, each of the hanging implements becomes locked to a specific position along the elongated body.

According to still further features in the described preferred embodiments (a) at least one of the hanging implements further includes a second securing device having a fifth profile, the second securing device is connected to or integrally formed with the hanging device; and (b) the elongated body further includes a second extended securing groove, the second extended securing groove extending along the elongated body starting at the first end, the second extended securing groove has a sixth profile, the sixth profile is shaped and dimensioned to slideably accommodate the fifth profile of the second securing device of the hanging implement, such that the second securing device is inserted into the second extended securing groove via the first end.

According to still further features in the described preferred embodiments the tool rack further comprising a first end cover for covering the first end.

According to still further features in the described preferred embodiments the tool rack further comprising at least one wall engagement device connected to or integrally formed with the elongated body.

According to still further features in the described preferred embodiments the first end cover includes a detachable display engagement device connected to or integrally formed with the first end cover.

According to still further features in the described preferred embodiments the hanging device of at least one of the hanging implements is shaped as a first hook.

According to still further features in the described preferred embodiments the hanging device of at least one of the hanging implements includes a second hook engaged by the first hook.

According to still further features in the described preferred embodiments the second hook includes an anti-slip layer lining its interface engaging the tool, such that the tool is prevented from slipping.

According to still further features in the described preferred embodiments anti-slip layer is made of robber.

According to still further features in the described preferred embodiments the tool rack comprising (a) at least one hanging implement for hanging a tool including (i) a hanging device being shaped as a first hook; (ii) a second hook being engaged by the first hook, the second hook including an anti-slip layer lining its interface engaging a tool, such that the tool is prevented from slipping; and (ii) a first securing device having a first profile, the first securing device being connected to or integrally formed with the hanging device; and (b) an elongated body including a first end, the elongated body being formed with a first extended securing groove, the first extended securing groove extending along the elongated body starting at the first end, the first extended securing groove having a third profile, the third profile being shaped and dimensioned to slideably accommodate the first profile of the first securing device of the hanging implement, such that the first securing device is inserted into the first extended securing groove via the first end.

According to still further features in the described preferred embodiments (a) at least one of the hanging implements farther includes a second securing device having a fifth profile, the second securing device is connected to or integrally formed with the hanging device; and (b) the elongated body further includes a second extended securing groove, the second extended securing groove extending along the elongated body starting at the first end, the second extended securing groove has a sixth profile, the sixth profile is shaped and dimensioned to slideably accommodate the fourth profile of the second securing device of the hanging implement, such that the second securing device is inserted into the second extended securing groove via the first end.

The present invention successfully addresses the shortcomings of the presently known configurations by providing a tool rack which can be used to hang tools such as garden tools on a wall, and which have advantages in two main aspects. First, with respect to the way in which the hanging implements are locked in position with respect to the body of the tool rack; and second, with respect to the rubber lining covering the interface of the hanging implement which is in contact with the tool, which lining prevents slipping of a tool from the rack.

BRIEF DESCRIPTION OF THE DRAWINGS

The invention herein described, by way of example only, with reference to the accompanying drawings, wherein.

DESCRIPTION OF THE PREFERRED EMBODIMENTS

The present invention is of a tool rack which can be used to hang tools such as garden tools on a wall.

The principles and operation of a tool rack according to the present invention may be better understood with reference to the drawings and accompanying descriptions.

Figure 1:
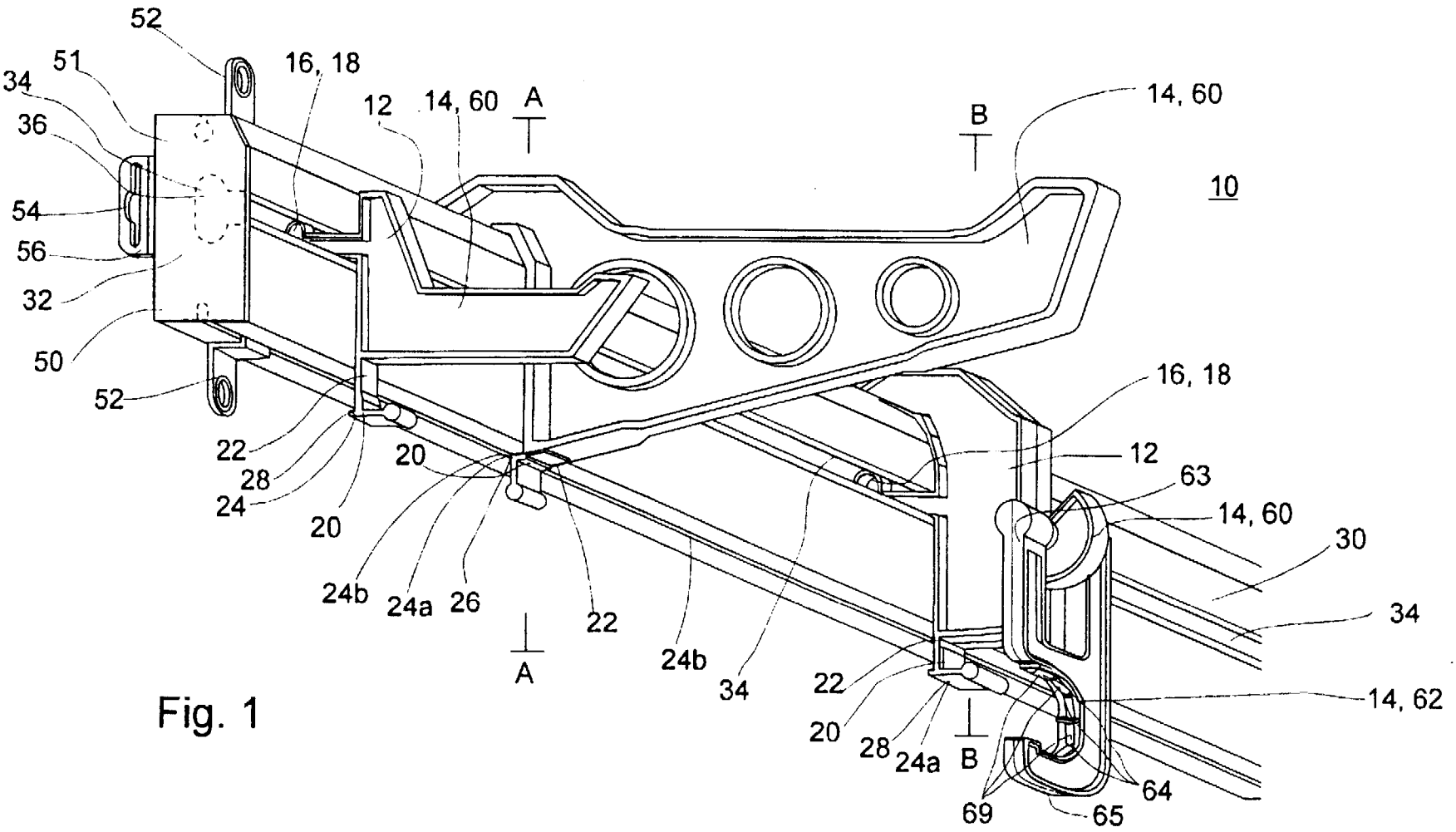
FIG. 1 is a perspective view of the tool rack according to the present invention.
Figure 2B:
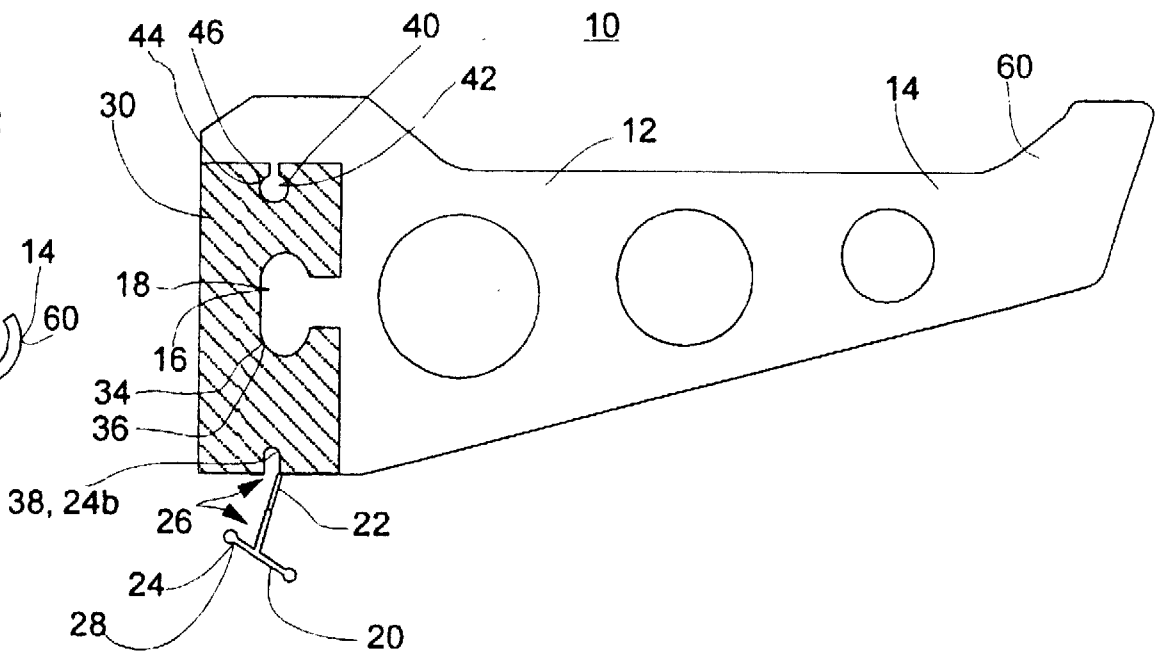
FIGS. 2a–b are cross section views of the tool rack of FIG. 1.
Figure 2A:
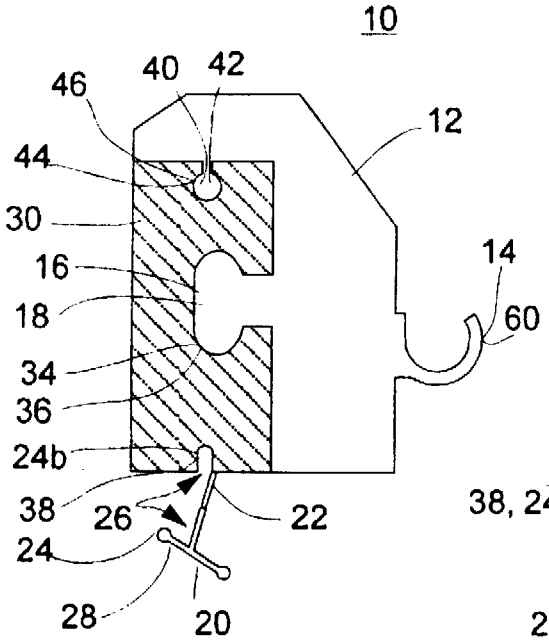

Referring now to the drawings. FIG. 1 illustrates a perspective view of few preferred embodiments of the tool rack according to the present invention, referred to hereinbelow as tool rack 10, whereas FIGS. 2a–b, illustrate cross section views of rack 10, along lines A—A and B—B, respectively, shown in FIG. 1.

Thus, tool rack 10 includes at least one, preferably few, hanging implements 12 (three are shown in FIG. 1), each serves for hanging a tool (not shown). As will be described in greater detail below, each of hanging implements 12 may acquire any specific shape rendering it most suitable for engaging any specific tool.

To this end, each of hanging implements 12 includes a hanging device 14 shaped suitable for engaging a tool. Each of hanging implements 12 further includes a first securing device 16 having a first profile 18, best seen in FIGS. 2a–b. First securing device 16 is connected (e.g., welded, glued) to or preferably integrally formed with hanging device 14 and is used to secure hanging implements 12 to a body 30 of rack 10, as is further detailed hereinbelow.

Each of hanging implements 12 further includes a locking device 20. Locking device 20 includes an integral hinge 22, preferably made of a thin (e.g., about 0.7 mm) flexible piece of plastic, connected to or preferably integrally formed with hanging device 14, and a first member 24a of a locking implement 26 connected to or integrally formed with hinge 22. First member 24a of locking implement 26 has a second profile 28. As is further detailed hereinbelow, first member 24a of locking implement 26 is for locking hanging implement 12 in a fixed position along body 30 of rack 10.

As already mentioned, tool rack 10 further includes an elongated body 30. Body 30 includes a first end 32, best seen in FIG. 1. Body 30 is formed with a first extended securing groove 34. As best seen in FIG. 1, first extended securing groove 34 extends along elongated body 30, starting at first end 32. First extended securing groove 34 has a third 36 profile, best seen in FIGS. 2a–b. Third profile 36 of first extended securing groove 34 is shaped and dimensioned to slideably accommodate first profile 18 of first securing device 16 of hanging implement 12, such that first securing device 16 is inserted into first extended securing groove 34 via first end 32 and slide to its position.

Body 30 is further formed with a second member 24b of locking implement 26. Second member 24b of locking implement 26 has a fourth profile 38 shaped and dimensioned to tightly accommodate second profile 28 of first member 24a of locking implement 26. By bending first member 24a of locking implement 26 via integral hinge 22, and engaging first 24a and second 24b members of locking implement 26 with one another, first 24a and second 24b members of locking implement 26 become locked to one another (as shown for middle hanging implement 12 in FIG. 1). As a result, each of hanging implements 12 becomes locked to a specific desired position along elongated body 30.

In a preferred embodiment, first member 24a of locking implement 26 is formed as a protrusion which tightly fits within a locking grove which forms the second 24b member of locking implement 26. Alternatively, second 24b member of locking implement 26 may be formed as a set of holes (not shown) along body 30, each of the holes is shaped and dimensioned to tightly accommodate the protrusion formed in hanging implement 12.

Depending on the specific application the length of body 30 may vary. In some embodiments the length of body 30 may be selected relatively short (e.g., 60–120 cm), whereas in other embodiments the length of body 30 may be selected longer (e.g., 2–10 m). Body 30 is preferably manufactured from a long piece which is cut to in any desired length.

Furthermore, the cross section of body 30 may vary. As presented in the Figures, the cross section of body 30 may be rectangular with one of its edges cur away, yet this configuration is for exemplification only and is not intended to limit the scope of the invention to any specific cross-sectional configuration. In any case, the cross section selection of hanging implements 12 is limited by the cross-section selected for body 30, as these components should fit in a fashion typically shown in the Figures.

In a preferred embodiment of the present invention, as best seen in FIGS. 2a–b, at least one of hanging implements 12 further includes a second securing device 40 having a fifth profile 42. Second securing device 40 is connected to or preferably integrally formed with hanging device 12. In this case, elongated body 30 further includes a second extended securing groove 44. Similar to groove 34, second extended securing groove 44 extends along body 30, starting at first end 32. Second extended securing groove 44 has a sixth profile 46. Sixth profile 46 is shaped and dimensioned to slideably accommodate fifth profile 42 of second securing device 40 of hanging implement 12, such that second securing device 40 is inserted into said second extended securing groove 44 via said first end and hanging implement 12 is thereafter slide to its appropriate position along body 30.

The shapes and dimensions of the profiles hereinabove mentioned may vary to a great degree, provided that matching profiles are selected compatible to one another and therefore provide slideable or tight accommodation of one with respect to the other, as described above.

As shown in FIG. 1, in a preferred embodiment of the invention tool rack 10 further includes a first end cover 50 for covering first end 32 of body 30. Typically tool rack 10 would further include a second end cover (not shown) for covering the other end (not shown) of body 30. Each of first and second end covers 50 preferably includes a detachable display engagement device 54 connected to or preferably integrally formed therewith.

Detachable display engagement device 54 is for engaging tool rack 10 on a displaying element, such as a pegboard (not shown) in retail outlets. Detachable display engagement device 54 includes a thin (e.g., about 0.7 mm) domain 56 located close to where it connects to cover 50, such that it may be easily removed by a user.

Figure 3:
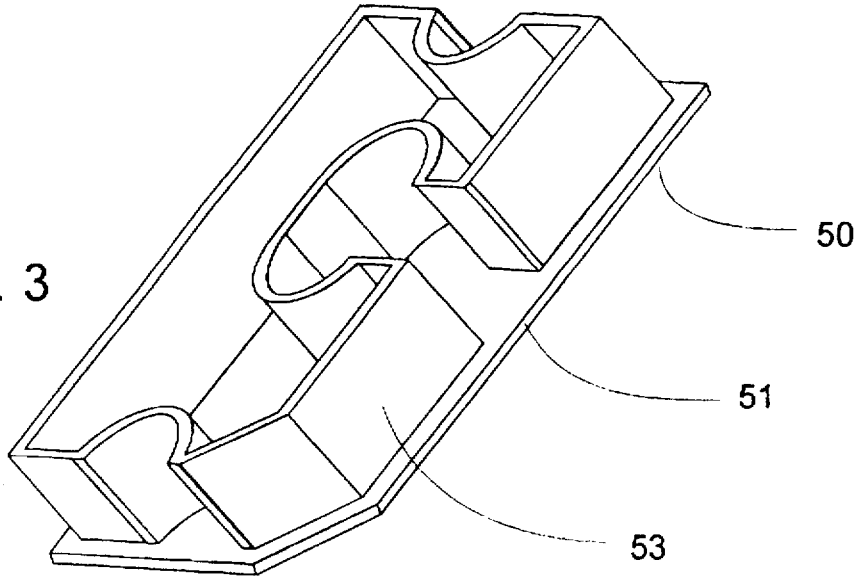
FIG. 3 is a perspective view of a cover employed with the tool rack according to the present invention.

As shown in FIGS. 1 and 3, each of covers 50 includes a cover end 51 and is devised to snap to first (and/or the other)

end 32 of body 30. To this end cover 50 includes a profile 53 which tightly accommodates profiles 18, 38 and 42 of formed in body 30.

As further shown in FIG. 1, in a preferred embodiment of the invention tool rack 10 further includes at least one wall engagement devices 52 connected to or integrally formed with elongated body 30. Preferably, wall engagement devices 52 are formed suitable for engaging tool rack 10 to a wall via screws (not shown). In a preferred embodiment of the invention, as shown in FIG. 1, wall engagement devices 52 are connected to body 30 of tool rack 10 by providing devices 52 with suitable profiles and sliding devices 52 into second extended securing groove 44 and second member 24*b* of locking implement 26.

In one embodiment of the present invention, hanging device 14 of hanging implements 12 is shaped as a hook, which is referred to herein below as first hook 60. As shown in FIG. 1, in one embodiment of the invention hanging device 14 of hanging implement 12 includes a second hook 62 engaged by first hook 60. In this case first hook 60 serves as a hinge for hingedly accommodating second hook 62.

Figure 4:
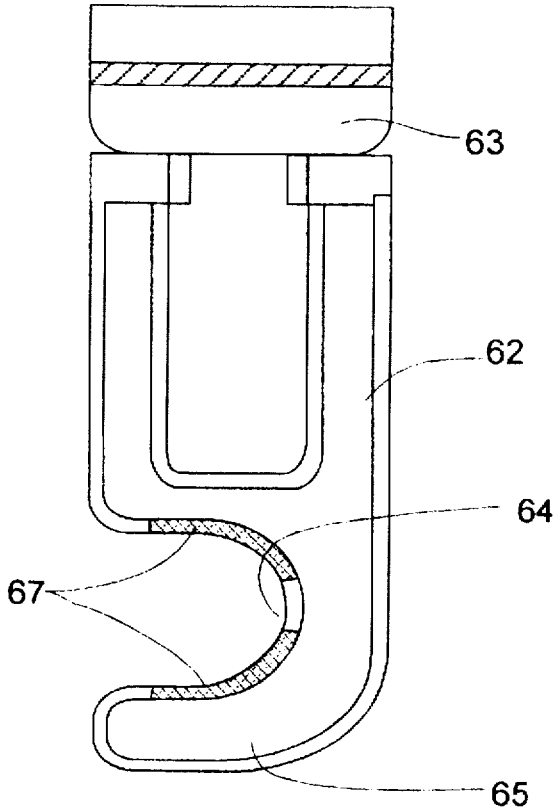
FIG. 4 is a side view of a hook having an anti-slip lining according to the present invention.

As shown in FIGS. 1 and 4, in a preferred embodiment of the invention, second hook 62 includes a first hook engaging end 63, which serve to engage second hook 62 onto first hook 60. Second hook 62 further includes a hanging end 65 used to hang a tool (not shown). Hanging end 65 is covered with an anti-slip layer 67 lining its interface 64 engaging the tool, such that the tool is prevented from slipping. Preferably anti-slip layer 64 is made of rubber. Connecting anti-slip layer 67 onto interface 64 is preferably effected by a snap connection. To this end, interface 64 is equipped with protrusions 69, whereas and-slip layer 67 is equipped with matching recessions (not shown), such that anti-slip layer 67 can be snapped onto interface 64.

In a preferred embodiment of the invention all the components of tool rack 10 are made of plastic, unless otherwise specified.

The operation of tool rack 10 according to its preferred embodiments hereinabove described is as follows. First, the user attaches a desired number of hanging implements 12 onto body 30 by inserting their first securing device 16 (or first 16 and second 40 securing devices) in a desired order into first 34 (or first 34 and second 44, respectively) extended securing groove, via first end 32 of body 30. Second, after spacing and positioning hanging implements 12 in specific desired positions along body 30, the user locks each of hanging implements 12 to its specified location via locking implement 26. Third, the user inserts wall engagement devices 52 into second extended securing groove 44 and second member 24*b* of locking implement 26. Fourth, the user detaches (e.g., cuts away) detachable display engagement device 54 along thin domains 56. Fifth, the user covers the ends of body 30 with covers 50. And finally, using screws, the used connects tool rack 10 to a wall in a desired height and location, via wall engagement devices 52. Tool rack 10 is now ready for use.

While the invention has been described with respect to a limited number of embodiments, it will be appreciated that many variations, modifications and other applications of the invention may be made.

What is claimed is:

1. A tool rack for hanging tools, comprising:

(a) at least one hanging implement for hanging a tool, each of said at least one hanging implements including:

(i) a hanging device for engaging said tool;

(ii) a first securing device having a first profile, said first securing device being connected to said hanging device; and (iii) a locking device, said locking device including an integral hinge connected to said hanging device and a first member of a locking implement connected to said hinge, said first member of said locking implement having a second profile; and (b) an elongated body including a first end, said elongated body being formed with:

(i) a first extended securing groove, said first extended securing groove extending along said elongated body starting at said first end, said first extended securing groove having a third profile, said third profile being shaped and dimensioned to slideably accommodate said first profile of said first securing device of said hanging implement, such that said first securing device is inserted into said first extended securing groove via said first end; and (ii) a second member of said locking implement, said second member of said locking implement having a fourth profile shaped and dimensioned to tightly accommodate said second profile of said first member of said locking implement, such that by bending said first member of said locking implement via said integral hinge said first and second members of said locking implement become locked to one another and, as a result, each of said at least one hanging implements becomes locked to a specific position along said elongated body;

wherein at least one of said hanging implements further includes a second securing device having a fifth profile, said second securing device is connected to said hanging device, and further wherein said elongated body further includes a second extended securing groove, said second extended securing groove extending along said elongated body starting at said first end, said second extended securing groove has a sixth profile, said sixth profile is shaped and dimensioned to slideably accommodate said fifth profile of said second securing device of said hanging implement, such that said second securing device is inserted into said second extended securing groove via said first end.

2. A tool rack as in claim 1, further comprising a first end cover for covering said first end.

3. A tool rack as in claim 1, further comprising at least one wall engagement device connected to said elongated body.

4. A tool rack as in claim 2, wherein said first end cover includes a detachable display engagement device connected to said first end cover.

5. A tool rack as in claim 1, wherein said hanging device of said at least one hanging implement is shaped as a first hook.

6. A tool rack for hanging tools, comprising:

(a) at least one hanging implement for hanging a tool, each of said at least one hanging implements including:

(i) a hanging device for engaging said tool;

(ii) a first securing device having a first profile, said first securing device being connected to said hanging device; and (iii) a locking device, said locking device including an integral hinge connected to said hanging device and a first member of a locking implement connected to said hinge, said first member of said locking implement having a second profile; and (b) an elongated body including a first end, said elongated body being formed with:

(i) a first extended securing groove, said first extended securing groove extending along said elongated body starting at said first end, said first extended securing groove having a third profile, said third profile being shaped and dimensioned to slideably accommodate said first profile of said first securing device of said hanging implement such that said first securing device is inserted into said first extended securing groove via said first end; and (ii) a second member of said locking implement said second member of said locking implement having a fourth profile shaped and dimensioned to tightly accommodate said second profile of said first member of said locking implement, such that by bending said first member of said locking implement via said integral hinge said first and second members of said locking implement become locked to one another and, as a result, each of said at least one hanging implements becomes locked to a specific position along said elongated body;

wherein said hanging device of said at least one hanging implement is shaped as a first hook and further wherein said hanging device of said at least one hanging implement includes a second hook engaged by said first hook.

7. A tool rack as in claim 6, wherein said second hook includes an anti-slip layer lining its interface engaging the tool, such that the tool is prevented from slipping.

8. A tool rack as in claim 7, wherein anti-slip layer is made of rubber.

9. A tool rack for hanging tools, comprising:

(a) at least one hanging implement for hanging a tool including:

(i) a hanging device being shaped as a first hook;

(ii) a second hook being engaged by said first hook, said second hook including an anti-slip layer lining its interface engaging a tool, such that the tool is prevented from slipping; and (ii) a first securing device having a first profile, said first securing device being connected to said hanging device; and (b) an elongated body including a first end, said elongated body being formed with a first extended securing groove, said first extended securing groove extending along said elongated body starting at said first end, said first extended securing groove having a third profile, said third profile being shaped and dimensioned to slideably accommodate said first profile of said first securing device of said hanging implement, such that said first securing device is inserted into said first extended securing groove via said first end;

wherein at least one of said hanging implements further includes a second securing device having a fifth profile, said second securing device is connected to said hanging device, and further wherein said elongated body further includes a second extended securing groove, said second extended securing groove extending along said elongated body starting at said first end, said second extended securing groove has a sixth profile, said sixth profile is shaped and dimensioned to slideably accommodate said fourth profile of said second securing device of said hanging implement, such that said second securing device is inserted into said second extended securing groove via said first end.

10. A tool rack as in claim 9, further comprising a first end cover for covering said first end.

11. A tool rack as in claim 10, wherein said first end cover includes a detachable display engagement device connected to said first end cover.

12. A tool rack as in claim 9, further comprising at least one wall engagement device connected to said elongated body.

* * * * *